US007855722B2

(12) United States Patent
Kim et al.

(10) Patent No.: US 7,855,722 B2
(45) Date of Patent: Dec. 21, 2010

(54) LIQUID CRYSTAL DISPLAY DEVICE AND ITS DRIVING METHOD

(75) Inventors: Shawn Kim, Suwon-si (KR); Yeon Shil Jung, Suwon-si (KR); Ji Hyun Jeon, Suwon-si (KR); Seo Hee Ha, Suwon-si (KR); Yang Soo Kim, Suwon-si (KR)

(73) Assignee: Samsung Mobile Display Co., Ltd., Giheung-Gu, Yongin, Gyunggi-Do (KR)

( * ) Notice: Subject to any disclaimer, the term of this patent is extended or adjusted under 35 U.S.C. 154(b) by 701 days.

(21) Appl. No.: 11/713,613

(22) Filed: Mar. 5, 2007

(65) Prior Publication Data

US 2008/0068321 A1 Mar. 20, 2008

(30) Foreign Application Priority Data

Sep. 18, 2006 (KR) ..... 10-2006-0090130

(51) Int. Cl.
*G09G 3/36* (2006.01)

(52) U.S. Cl. ..... 345/211; 345/96

(58) Field of Classification Search ..... 345/87–100, 345/206, 209–211
See application file for complete search history.

(56) References Cited

U.S. PATENT DOCUMENTS

| | | | | |
|---|---|---|---|---|
| 7,030,869 | B2 * | 4/2006 | Morita | 345/208 |
| 7,545,343 | B2 * | 6/2009 | Ogino et al. | 345/30 |
| 7,609,256 | B2 * | 10/2009 | Morita | 345/211 |
| 2004/0125066 | A1 * | 7/2004 | Park et al. | 345/92 |
| 2005/0088395 | A1 * | 4/2005 | Chung | 345/98 |
| 2007/0001978 | A1 * | 1/2007 | Cho | 345/98 |
| 2007/0070013 | A1 * | 3/2007 | Chen et al. | 345/94 |

FOREIGN PATENT DOCUMENTS

| | | | |
|---|---|---|---|
| KR | 1020040061205 | A | 7/2004 |
| KR | 1020040073703 | A | 8/2004 |
| KR | 10-2006-0014726 | | 2/2006 |

OTHER PUBLICATIONS

*Notice of Allowance* from the Korean Intellectual Property Office issued in Applicant's corresponding Korean Patent Application No. 10-2006-0090130 dated Aug. 31, 2007.

* cited by examiner

*Primary Examiner*—Amare Mengistu
*Assistant Examiner*—Dmitriy Bolotin
(74) *Attorney, Agent, or Firm*—Robert E. Bushnell, Esq.

(57) ABSTRACT

A Liquid Crystal Display (LCD) includes: a liquid crystal panel having liquid crystal cells divided by scan lines and data lines and arranged in a matrix shape; a data driving circuit to supply an image signal to the liquid crystal cells via the data lines; a scan driving circuit to sequentially select and scan the scan lines and to control an on/off state of switching elements arranged in each of the liquid crystal cells; a timing controller to drive both the data driving circuit and the scan driving circuit, based on an externally inputted signal; and a common electrode driving circuit to drive a common electrode of the liquid crystal panel. The common electrode driving circuit supplies a common voltage to the common electrode, the common voltage including a DC voltage for a first period of a first horizontal period (1H) and another voltage for a second remaining period of the first horizontal period (1H).

11 Claims, 3 Drawing Sheets

LIQUID CRYSTAL DISPLAY DEVICE AND ITS DRIVING METHOD

CLAIM OF PRIORITY

This application makes reference to, incorporates the same herein, and claims all benefits accruing under 35 U.S.C. §119 from an application for LIQUID CRYSTAL DISPLAY DEVICE AND DRIVING METHOD THEREOF earlier filed in the Korean Intellectual Property Office on the 18$^{th}$ day of Sep. 2006 and there duly assigned Serial No. 10-2006-0090130.

BACKGROUND OF THE INVENTION

1. Field of the Invention

The present invention relates to a Liquid Crystal Display (LCD), and more particularly to an LCD capable of removing noise generated when driven in an AC mode, and its driving method.

2. Discussion of Related Art

There has been an increasing demand for a display device for displaying an image together with the growth of an information-oriented society, and various flat panel displays such as Liquid Crystal Displays (LCDs), Plasma Display Panels (PDPs), Organic Light Emitting Diodes (OLEDs), and Vacuum Fluorescent Displays (VFDs) have been widely used in recent years.

Among the flat panel displays, LCDs have been widely used in recent years since they are generally driven in an active matrix mode using Thin Film Transistor (TFT) elements, etc. and they are also small-sized, light weight and thin and driven at a low power. An LCD includes a liquid crystal interposed between two substrates and two opposing substrates, and an image is displayed by changing an arrangement of a liquid crystal with an electric field generated between a pixel electrode and a common electrode formed in the two substrates.

That is to say, as shown in FIG. 1, an LCD includes a liquid crystal panel 51 in which a liquid crystal 54 is interposed between a first substrate 52 and a second substrate 53, the first substrate 52 having a TFT and a pixel arranged to face each other and the second substrate 53 having a color filter and a common electrode formed therein. The liquid crystal panel 51 has a liquid crystal cell (pixel) divided by scan signal lines and data signal lines arranged in a matrix shape, and an image is displayed on the liquid crystal panel 51 by controlling a molecular arrangement direction of the liquid crystal compound in every liquid crystal cell.

The molecular arrangement direction of the liquid crystal compound in the liquid crystal cell is controlled by opposite electrodes formed in a surface of the second substrate 53, namely by a voltage supplied to the common electrode and a voltage supplied to a pixel electrode of the first substrate 52 in an ON/OFF operation of the TFT formed in every liquid crystal cell.

Also, in order to ensure reliability of liquid crystal materials, namely to prevent deterioration of the liquid crystal, the liquid crystal display is generally driven in an AC driving mode for reversing a polarity of a voltage supplied to liquid crystal of pixels in every predetermined period.

In the driving system of the LCD in an AC driving mode, there are a line inversion system, a source inversion system, a dot inversion system, etc. In the line inversion system among them, the polarity is reversed in every LOW line on a panel, to thereby supply an image signal to each of the liquid crystal cells.

That is to say, as shown in FIG. 2, for example, a polarity of a voltage supplied to the liquid crystal cells is reversed by changing a voltage (a solid line in the drawing) supplied to the common electrode in every first horizontal period (1H) and a voltage of the image signal (a dotted line in the drawing) supplied to the liquid crystal cells in the line inversion system.

If the liquid crystal is driven in an AC driving mode as described above, then signals with reverse phases are respectively supplied to a pair of electrodes (a common electrode and a pixel electrode), and then a voltage (bias) is supplied between these electrodes.

Accordingly, the liquid crystal display is driven by the line inversion system, and therefore, the second substrate 53, in which the common electrode is formed, depending on the voltage supplied to the common electrode can vibrate.

The second substrate 53 vibrates in a range of about 10 kHz in driving the liquid crystal display since a driving frequency (a frequency of the voltage supplied to the common electrode) of the common electrode is about 10 kHz in a liquid crystal panel for recent portable devices.

The vibration is recognized by users as audio noise, since it is a vibration having a frequency within a human audible bandwidth range.

Such a noise has become a serious problem in recent years since the reduced thickness of portable devices using an LCD results in a smaller distance between a liquid crystal panel and the portable devices.

SUMMARY OF THE INVENTION

Accordingly, the present invention is designed to solve such drawbacks of the prior art, and it is therefore an object of the present invention to provide a Liquid Crystal Display (LCD) and its driving method, the LCD being driven in a line inversion system, the LCD capable of removing audible noise by setting a driving frequency of a common electrode to a wider range than a human audible bandwidth without an increase of the entire frame frequency since a period when a common voltage is actually supplied may be reduced by supplying to the common electrode a DC voltage for a predetermined period out of a first horizontal period (1H) of the voltage supplied and supplying a common voltage that should be actually supplied for the other remaining first horizontal period, the DC voltage corresponding to one half of a sum of the common voltage and the pixel voltage that should be supplied for the first horizontal period.

One embodiment of the present invention is achieved by providing a Liquid Crystal Display (LCD) including: a liquid crystal panel having liquid crystal cells divided by scan lines and data lines and arranged in a matrix shape; a data driving circuit to supply an image signal to the liquid crystal cells via the data lines; a scan driving circuit to sequentially select and scan the scan lines and to control an on/off state of switching elements arranged in each of the liquid crystal cells; a timing controller to drive both the data driving circuit and the scan driving circuit, based on an externally inputted signal; and a common electrode driving circuit to drive a common electrode of the liquid crystal panel; the common electrode driving circuit supplies a common voltage to the common electrode, the common voltage including a DC voltage for a first period of a first horizontal period (1H) and another voltage for a second remaining period of the first horizontal period (1H).

The liquid crystal panel preferably includes: a first substrate having the scan lines and the data lines arranged therein and having a switching element and a pixel electrode arranged adjacent to respective intersection points of their signal lines; a second substrate arranged to face the first substrate and having the common electrode arranged on a front surface thereof and having Red (R), Green (G), and Blue (B) color filters arranged to respectively correspond to each of the pixel electrodes; and a liquid crystal sealed between the first and second substrates.

A polarity of the common voltage supplied to the common electrode is preferably reversed and supplied to be suitable for a reversed polarity of the voltage supplied to the pixel electrodes, an effective value of the voltage supplied to the liquid crystal remaining constant upon a polarity of the voltage supplied to the pixel electrodes being reversed. A polarity of the common voltage is preferably reversed and supplied in every second period of the first horizontal period (1H).

The common DC voltage preferably includes one half (½) of a sum of the common voltage and the pixel voltage supplied during the first horizontal period (1H).

The pixel voltage corresponding to the common voltage is preferably supplied to be suitable for the second period of the first horizontal period (1H).

Another embodiment of the present invention is achieved by providing a method of driving a Liquid Crystal Display (LCD) to display an image on a liquid crystal panel, the method including: arranging scan lines and data lines on the liquid crystal panel; arranging respective pixel electrodes on the liquid crystal panel in regions divided into a matrix shape by the scan lines and the data lines; arranging a common electrode on the liquid crystal panel; interposing a liquid crystal layer between the common electrode and the pixel electrodes; and supplying a common voltage to the common electrode, the common voltage including a DC voltage for a first period of a first horizontal period (1H) and another voltage for a second remaining period of the first horizontal period (1H).

A polarity of the common voltage supplied to the common electrode is preferably reversed and supplied to be suitable for a reversed polarity of the voltage supplied to the pixel electrodes, an effective value of the voltage supplied to the liquid crystal remaining constant upon a polarity of the voltage supplied to the pixel electrodes being reversed. A polarity of the common voltage is preferably reversed and supplied in every second period of the first horizontal period (1H).

The common DC voltage preferably includes one half (½) of a sum of the common voltage and the pixel voltage supplied during the first horizontal period (1H).

The pixel voltage corresponding to the common voltage is preferably supplied to be suitable for the second period of the first horizontal period (1H).

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Hereinafter, an exemplary embodiment of the present invention is described with reference to the accompanying drawings.

Figure 1:
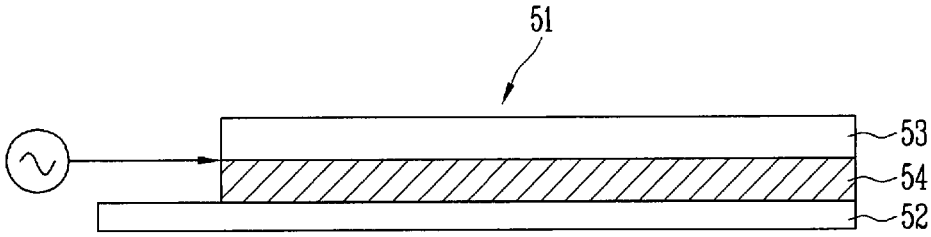
FIG. 1 (PRIOR ART)
FIG. 1 is a cross-sectional view of a liquid crystal panel provided in a conventional liquid crystal display.
Figure 2:
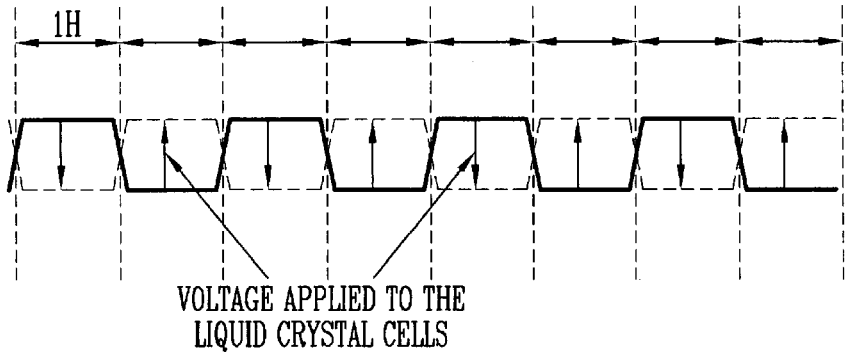
FIG. 2 (PRIOR ART)
FIG. 2 are waveforms of drive timings of a common electrode and a pixel electrode in a conventional line inversion system.
Figure 3:
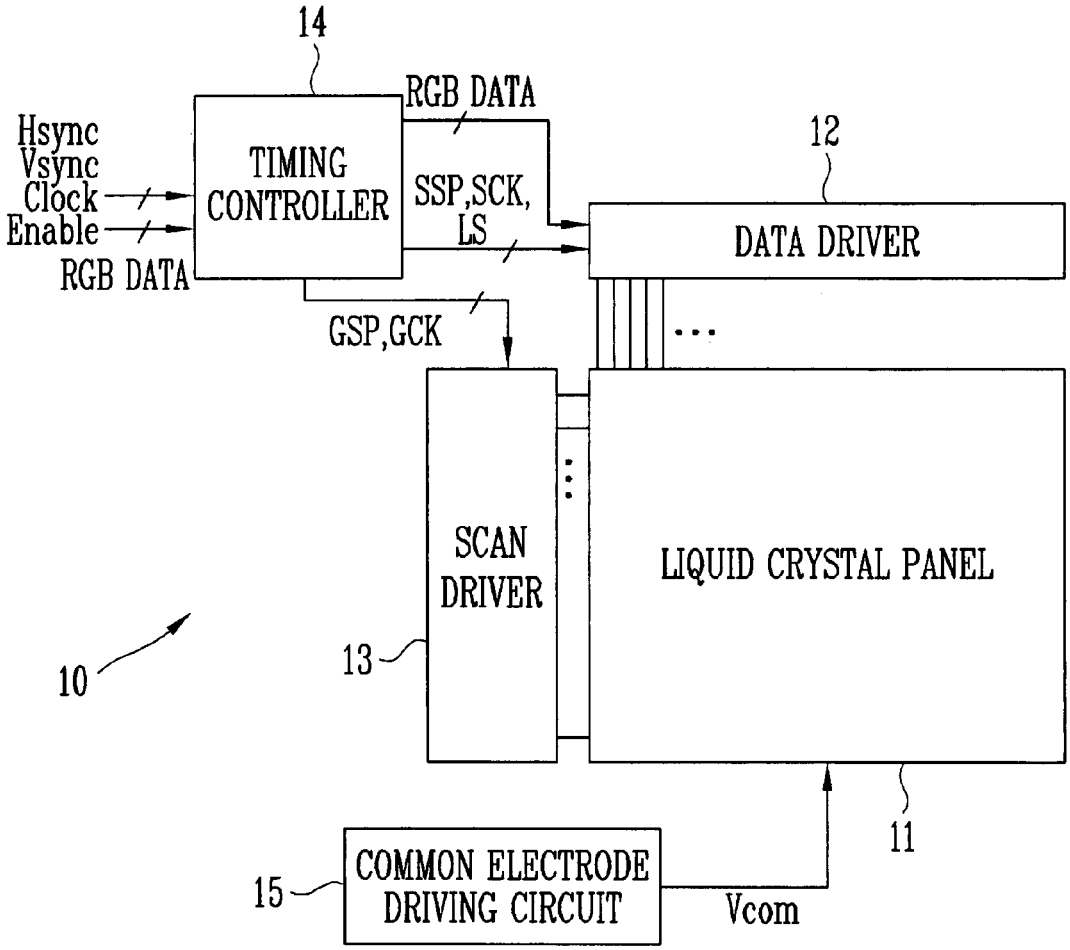
FIG. 3 is a block diagram of a Liquid Crystal Display (LCD) according to one embodiment of the present invention.
Figure 4:
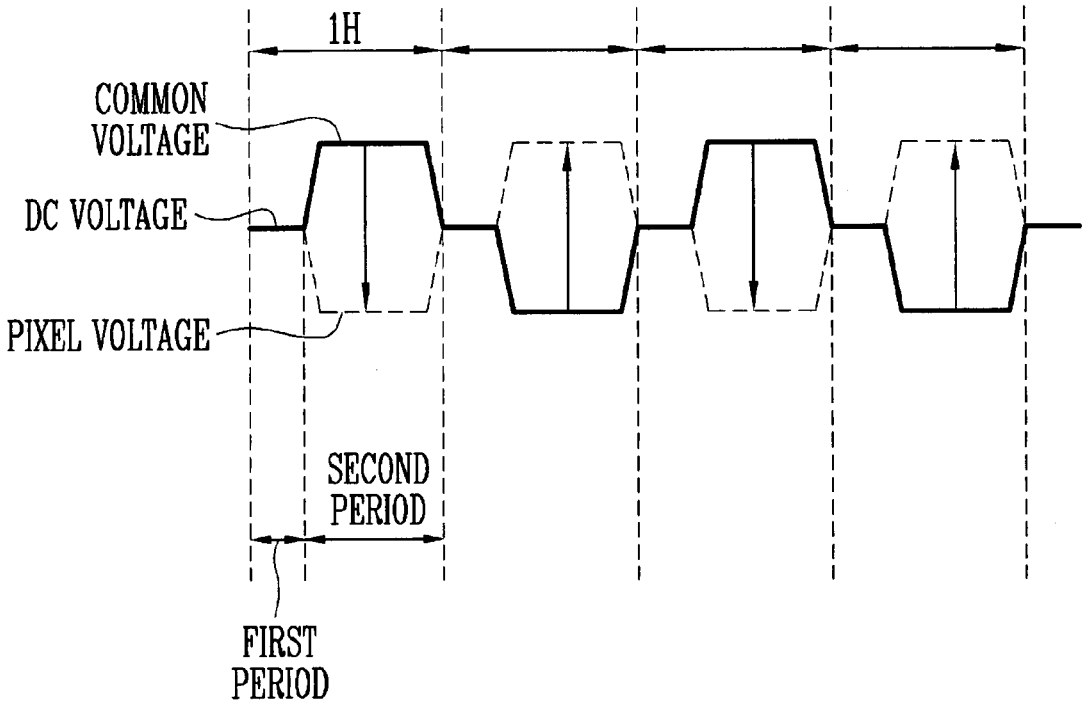
FIG. 4 are waveforms of drive timings of a common electrode and a pixel electrode when the liquid crystal display according to one embodiment of the present invention is driven.

FIG. 3 is a block diagram of a Liquid Crystal Display (LCD) according to one embodiment of the present invention, and FIG. 4 are waveforms of drive timings of a common electrode and a pixel electrode when the liquid crystal display according to one embodiment of the present invention is driven.

Referring to FIG. 3, the LCD 10 according to one embodiment of the present invention includes a liquid crystal panel 11 having liquid crystal cells divided by scan lines and data lines and arranged in a matrix shape; a data driving circuit 12 for supplying an image signal (image data) to the liquid crystal cells through the data lines; a scan driving circuit 13 for sequentially selecting and scanning scan lines and controlling a turned-on/off state of a switching element existing in each of the liquid crystal cells; a timing controller 14 for driving the data driving circuit 12 and the scan driving circuit 13, based on a signal inputted from the outside; and a common electrode driving circuit 15 for driving a common electrode provided in the liquid crystal panel.

The liquid crystal panel 11 is driven to sequentially display an image of only one frame on the liquid crystal panel 11 by using the data driving circuit 12, the scan driving circuit 13, the timing controller 14, and the common electrode driving circuit 15.

The liquid crystal panel 11 is formed by facing a pair of transparent substrates and sealing a liquid crystal (a liquid crystal layer) between a pair of the substrates. Scan lines and data lines are arranged on a first substrate of the pair of the substrates, and a switching element such as TFT, and a pixel electrode are formed adjacent to intersection points of their signal lines.

A common electrode is formed in the second substrate facing the first substrate, and R (red), G (green) and B (blue) color filters are arranged in the second substrate, the color filters corresponding to each of the pixel electrodes.

The timing controller 14 receives a vertical synchronizing signal (Vsync), a horizontal synchronizing signal (Hsync), a clock signal (Clock), an enable signal (Enable), a RGB data signal (DATA), and generates a source start signal (SSP), a source clock signal (SCK), a latch signal (LS), a gate start signal (GSP) and a gate clock signal (GCK) in response to the inputted signals.

The data signal (DATA), the source start signal (SSP), the source clock signal (SCK) and the latch signal (LS) are outputted to the data driving circuit 12, and the gate start signal (GSP) and the gate clock signal (GCK) are outputted to the scan driving circuit 13.

The data signal (DATA), the source start signal (SSP), the source clock signal (SCK), the latch signal (LS), the gate start signal (GSP) and the gate clock signal (GCK) are all driving signals for driving the liquid crystal panel 11.

The common electrode driving circuit 15 is driven by reversing a polarity of the common voltage (Vcom), supplied to the common electrode, to be suitable for a reversed polarity (a polarity of the image signal) of the voltage supplied to the pixel electrode so that an effective value of the voltage supplied to the liquid crystal are identical if a polarity of the voltage supplied to each of the pixel electrodes is reversed when the liquid crystal display 10 is AC-driven in a line inversion system.

Hereinafter, the driving method of the liquid crystal display is described in more detail.

Generally, an enabling of the image signal in each of the liquid crystal cells carried out in the liquid crystal display is carried out by the AC driving. For example, a polarity of the image signal supplied to the pixel electrode is reversed in every scan signal line (every scan period) when the liquid crystal display is AC-driven in a line inversion system. If the liquid crystal display is driven in the AC driving, then an effective value of the voltage supplied to the liquid crystal is determined by the difference between the voltage supplied to the pixel electrode and the voltage supplied to the common electrode, namely a common voltage (Vcom).

For this purpose, the Vcom is supplied to the common electrode so that an effective value of the voltage supplied to the liquid crystal can be identical even though a polarity of the voltage supplied to each of the pixel electrodes is reversed when the liquid crystal display is driven in a line inversion system. Accordingly, a polarity of the common voltage (Vcom) is necessarily reversed to be suitable for the polarity (a polarity of the image signal) of the voltage supplied to the pixel electrode.

If the liquid crystal display is driven to reverse the polarity of the Vcom, then the second substrate in which the common electrode is formed vibrates when a voltage is supplied to the common electrode, and the vibration is recognized as audio noise in driving the liquid crystal display if a vibration frequency of the second substrate is within a human audible bandwidth, as described above.

In order to solve the problems, the liquid crystal display according to one embodiment of the present invention removes audio noise by setting a driving frequency of a common electrode to a wider range than a human audible bandwidth without an increase of the entire frame frequency since a period when a common voltage is actually supplied may be reduced by supplying a DC voltage for a predetermined period (first period) out of a first horizontal period (1H) of the voltage supplied to the common electrode and supplying a common voltage for the other remaining first horizontal period (second period), the DC voltage corresponding to a half of the sum of the common voltage and the pixel voltage supplied for the first horizontal period, as shown in FIG. 4.

Generally, if the liquid crystal display is driven in a line inversion system, then the polarity of the common voltage (Vcom) is reversed in every first horizontal period (1H). Also, a driving frequency f(Hz) of the common electrode is represented by f(Hz)=½H period (herein, the 2H period means twice as much as an 1H) since a frequency is represented by the reciprocal of a period.

Accordingly, a driving frequency of the common electrode may be actually improved in the embodiment of the present invention, considering a period when a common voltage is actually supplied although a driving frequency of the common electrode is not changed, by supplying a DC voltage for a predetermined period, namely a first period, out of a first horizontal period (1H) and supplying a common voltage for the other remaining first horizontal period (second period), the DC voltage corresponding to a half of the sum of the common voltage and the pixel voltage that should be supplied for the first horizontal period, as described above.

For example, assume that a driving frequency of the common electrode is 10 KHz, a predetermined DC voltage is supplied during a period (a first period) corresponding to one half of the first horizontal period (1H), and a common voltage is supplied during a period (a second period) corresponding to the other half of the first horizontal period (1H).

A capacity of the DC voltage preferably corresponds to one half of the sum of the common voltage and the pixel voltage supplied during the first horizontal period.

The period when the common voltage is actually supplied is one half of the existing period since the common voltage is supplied only during the period corresponding to one half of the first horizontal period (1H), and therefore an actual driving frequency is 20 KHz (20,000 Hz).

However, the driving frequency of the common voltage is 10 kHz since it includes a period when the DC voltage is supplied. Accordingly, the driving frequency is represented by f(Hz)=10,000=½H period in the equation, and the 1H period is represented by 1H period=1/20,000 Hz=50 μs.

That is to say, when the 1H period is set to 50 μs as known in the art, an increase in the power consumption, required for driving the liquid crystal display, is prevented in this embodiment since the liquid crystal display is not driven at a high speed.

When a liquid crystal panel 11 having a resolution of QVGA (240×320 dot) is used for portable devices, etc., if the 1H period is set to 50 μs, then a period required for supplying a voltage to liquid crystal cells of only one frame is calculated by 50 μs×320 line=16 ms since the one frame has 320 scan signal lines. As a period required for displaying only on frame, a first vertical period (1V, a first frame period) is 1/60 s (about 16.7 ms) in the conventional liquid crystal display.

Accordingly, the increase of the power consumption required for driving the liquid crystal display is prevented by supplying a voltage to the liquid crystal cells of only one frame to be suitable for a conventional 1V period (about 16.7 ms) of only one frame since the driving frequency of the common electrode is not actually changed in this embodiment of the present invention.

The period when the common voltage is actually supplied is one half of the existing period since the common voltage is supplied only during the period corresponding to one half of the first horizontal period (1H), and therefore an actual driving frequency is 20 kHz (20,000 Hz), as described above. As a result, noise is removed by setting a driving frequency of a common electrode to a wider range than a human audible bandwidth without an increase of the entire frame frequency.

A polarity of the pixel voltage corresponding to the supplied common voltage is reversed and inputted during an 1H period in the same manner as described in the prior art, but the polarity of the pixel voltage is more preferably supplied to be suitable for a period when the common voltage is actually supplied, as shown in FIG. 4.

That is to say, driving frequencies (frequencies of the driving voltages) of the pixel electrode and the common electrode may be set to 20 kHz or more by driving the liquid crystal display in a manner of reversing a polarity of the driving voltage supplied to each of the pixel electrode and the common electrode in every ½ period out of the 1H periods in this embodiment. Accordingly, a vibration of the substrate is not recognized as audio noise by humans since the vibration of the substrate exceeds 20 kHz, namely, exceeds a human audible bandwidth, if the vibration occurs in the substrate.

As described above, according to the present invention, audio noise is removed by setting a driving frequency of a common electrode to a wider range than a human audible bandwidth without an increase of the entire frame frequency, the noise being generated in driving the liquid crystal display.

Also, the driving method of the present invention is more suitable for slim portable devices using the liquid crystal display.

The description above refers to just a preferable example for the purpose of illustration only and is not intended to limit the scope of the present invention. It should therefore be understood that other equivalents and modifications could be made thereto without departing from the spirit and scope of the present invention as apparent to those skilled in the art. Therefore, it should be understood that the present invention is not defined within the scope of the detailed description but rather within the scope defined in the following claims.

What is claimed is:

1. A Liquid Crystal Display (LCD) device, comprising:

a liquid crystal panel having liquid crystal cells divided by scan lines and data lines and arranged in a matrix shape;

a data driving circuit to supply an image signal to the liquid crystal cells via the data lines;

a scan driving circuit to sequentially select and scan the scan lines and to control an on/off state of switching elements arranged in each of the liquid crystal cells;

a timing controller to drive both the data driving circuit and the scan driving circuit, based on an externally inputted signal; and a common electrode driving circuit to drive a common electrode of the liquid crystal panel and to supply a common voltage to the common electrode, the common voltage including a DC voltage maintained during a first period of a first horizontal period (1H) and another voltage applied during a second remaining continuous period of the first horizontal period (1H), with the another voltage continuously having an opposite polarity compared to the image signal which is simultaneously supplied by the data driving circuit.

2. The liquid crystal display device according to claim 1, wherein the liquid crystal panel comprises:

a first substrate having the scan lines and the data lines arranged therein and having a switching element and a pixel electrode arranged adjacent to respective intersection points of their signal lines;

a second substrate arranged to face the first substrate and having the common electrode arranged on a front surface thereof and having Red (R), Green (G), and Blue (B) color filters arranged to respectively correspond to each of the pixel electrodes; and a liquid crystal sealed between the first and second substrates.

3. The LCD device according to claim 2, wherein a polarity of the common voltage supplied to the common electrode is reversed and supplied to be suitable for a reversed polarity of the voltage supplied to the pixel electrodes, an effective value of the voltage supplied to the liquid crystal remaining constant upon a polarity of the voltage supplied to the pixel electrodes being reversed.

4. The LCD device according to claim 1, wherein a polarity of the common voltage is reversed and supplied in every second period of the first horizontal period (1H).

5. The LCD device according to claim 1, wherein the common DC voltage comprises one half (½) of a sum of the common voltage and the pixel voltage supplied during the first horizontal period (1H).

6. The LCD device according to claim 1, wherein the pixel voltage corresponding to the common voltage is supplied to be suitable for the second period of the first horizontal period (1H).

7. A method of driving a Liquid Crystal Display (LCD) device to display an image on a liquid crystal panel, the method comprising:

arranging scan lines and data lines on the liquid crystal panel;

arranging respective pixel electrodes on the liquid crystal panel in regions divided by the scan lines and data lines into a matrix;

arranging a common electrode on the liquid crystal panel;

interposing a liquid crystal layer between the common electrode and the pixel electrodes; and supplying a common voltage to the common electrode, the common voltage including a DC voltage maintained during a first period of a first horizontal period (1H) and another voltage applied during a second remaining continuous period of the first horizontal period (1H), with the another voltage continuously having an opposite polarity compared to a voltage which is simultaneously applied on the pixel electrodes.

8. The method for driving an LCD device according to claim 7, wherein a polarity of the common voltage supplied to the common electrode is reversed and supplied to be suitable for a reversed polarity of the voltage supplied to the pixel electrodes, an effective value of the voltage supplied to the liquid crystal remaining constant upon a polarity of the voltage supplied to the pixel electrodes being reversed.

9. The method for driving an LCD device according to claim 7, wherein a polarity of the common voltage is reversed and supplied in every second period of the first horizontal period (1H).

10. The method for driving an LCD device according to claim 7, wherein the common DC voltage comprises one half (½) of a sum of the common voltage and the pixel voltage supplied during the first horizontal period (1H).

11. The method for driving an LCD device according to claim 7, wherein the pixel voltage corresponding to the common voltage is supplied to be suitable for the second period of the first horizontal period (1H).

* * * * *

(12) SUPPLEMENTAL EXAMINATION CERTIFICATE

United States Patent (10) Number: US 7,855,722 F1

Kim et al. (45) Certificate Issued: Jan. 21, 2016

Control No.: 96/000,124 Filing Date: Dec. 1, 2015

Primary Examiner: Eric B. Kiss

No substantial new question of patentability is raised in the request for supplemental examination. See the Reasons for Substantial New Question of Patentability Determination in the file of this proceeding.

(56) Items of Information

FOREIGN PATENT DOCUMENTS

| | | |
|---|---|---|
| KR | 1020060042038 A | 05/2006 |
| KR | 1020040024712 A | 03/2004 |
| JP | 2006023645 A | 01/2006 |